United States Patent [19]

Scheid

[11] 4,047,347

[45] Sept. 13, 1977

[54] WALL OR CEILING PANEL CONSTRUCTION

[76] Inventor: Lloyd J. Scheid, 4404 Grimes Place, Encino, Calif. 91316

[21] Appl. No.: 663,821

[22] Filed: Mar. 4, 1976

Related U.S. Application Data

[63] Continuation-in-part of Ser. No. 510,027, Sept. 27, 1974, abandoned.

[51] Int. Cl.[2] ..... E04B 2/00; E04C 2/00

[52] U.S. Cl. ..... 52/436; 52/593; 52/612; 52/434

[58] Field of Search ..... 52/436, 593, 595, 588, 52/241, 622, 586, 589, 424, 434, 578, 420, 287, 582

[56] References Cited

U.S. PATENT DOCUMENTS

| | | | |
|---|---|---|---|
| 2,009,056 | 7/1935 | Schaffert | 52/420 |
| 2,334,113 | 11/1943 | Malarkey | 52/455 |
| 2,341,645 | 2/1944 | Muench | 52/612 |
| 2,387,431 | 10/1945 | Du Laney | 52/434 |
| 3,241,276 | 3/1966 | Vance et al. | 52/434 |
| 3,357,146 | 12/1967 | Gartrell | 52/593 |
| 3,465,488 | 9/1969 | Miller | 52/241 |
| 3,640,191 | 2/1972 | Hendrich | 52/595 |
| 3,708,935 | 1/1973 | Kossuth et al. | 52/287 X |
| 3,791,082 | 2/1974 | Bowling | 52/90 |

*Primary Examiner*—Price C. Faw, Jr.

*Assistant Examiner*—Robert C. Farber

*Attorney, Agent, or Firm*—Mahoney, Schick & Cislo

[57] ABSTRACT

Panel constructions comprising wall or ceiling panels of, for example, fire resistive material such as gypsum board wherein at least one of the lateral edges of one panel has secured thereto a female mounting member and at least one opposed lateral edge of a second panel has secured thereto a male mounting member. The female mounting member has opposed flanges which receive therebetween opposed surfaces adjacent the lateral edge of the panel and is provided with a central elongate channel for making engagement with a like panel to which has been secured the male mounting member. The male mounting member also comprises a channel-like member secured along the edge wherein opposed flanges receive an intermediate portion of the panel and wherein a protuberance or projecting tongue is received in nesting relationship in the channel of the female member. A covering of vinyl or other decorative material, textured paint or other finish is applied to one surface of each of the panels. In the case of vinyl covering, the covering may overlie the one flange of either the female or male mounting member, or be coincident with the line of juncture of the abutted panels. The panel constructions are especially useful for providing fire resistive walls or ceilings economically and expeditiously of the type found in mobile homes and the like.

51 Claims, 16 Drawing Figures

2
52
56
58
4
8
30
6
54
60
44
36
34
57
42
22
20
14
26'
46
38
58
40
12
18
24
28
26
10
32

WALL OR CEILING PANEL CONSTRUCTION

REFERENCE TO RELATED APPLICATION

This application is a continuation-in-part of pending application Ser. No. 510,027, filed Sept. 27, 1974 (now abandoned).

BACKGROUND OF THE INVENTION

This invention pertains to wall or ceiling panel constructions particularly where the panels are of fire resistive construction such as gypsum board and other fire resistive materials wherein at least one of the lateral edges of one panel has secured thereto a female mounting member and at least one opposed lateral edge of a second panel has secured thereto a male mounting member whereby by vertical or horizontal erection a prefabricated wall or ceiling is provided to finish off the interior of a room. The panels of the invention have specific and particular adaptability to factory prefabricated homes commonly referred to as mobile homes.

With modern-day construction costs continuously increasing because of inflationary pressures both with respect to the materials and labor and more restrictive building codes with regard to fire safety, a means of finishing or remodeling the interior of rooms in as economical and safe fashion as possible is desirable.

The herein-disclosed invention pertains to, in an exemplary embodiment, a wall or ceiling panel construction utilizing a partially prefabricated panel with a mounting member which is easily installed on a wall or ceiling supporting surface or for example, furring strips or other wall or ceiling support structure on an in-factory, site or in the field by workmen having little or no skill in the erection of interior walls or ceilings. The panels of this invention make it possible to provide, in an easy and economical manner, a wall or ceiling construction of fire resistive characteristic which allows the side-by-side placement and securement of panels having various decorative, exterior finishes thereon.

While the prior art has suggested a plurality of wall and ceiling panels and systems therefor, it has been deficient in providing the simple, economically feasible and safety features of this invention.

OBJECTS AND SUMMARY OF THE INVENTION

It is an object of the invention to provide a panel construction.

It is another object of the invention to provide a panel construction and mounting member therefor which permits erection of panels in an easy manner.

It is another and still further important object of the invention to provide a panel construction wherein an elongate panel is provided along one of its lateral edges with a support member which interfits with a like panel having a different support member secured to one of the opposite lateral edges of the adjacently placed panel.

It is another and still further important object of the invention to provide a panel having along one of its lateral edges a female mounting member and wherein the opposed lateral edge has a male mounting member so that the like panels may be easily erected into a wall or ceiling configuration.

It is another and still further important object of the invention to provide panel constructions having along one of its edges a female mounting member comprising a channel-like configuration wherein opposed flanges intermediately receive the panel in a reinforcing manner and wherein the female member has an extending groove.

It is still another and still further important object of the invention to provide a panel construction wherein one of the lateral edges of the panel is provided with a secured male mounting member which has a channel-like configuration with opposed flanges which intermediately receives the edge of the panel in reinforced fashion and which has an intermediately disposed tongue which interfits into an adjacently positioned panel having a female mounting member secured thereto.

It is still another and further, more specific object of the invention to provide a panel assembly which has in partial, assembled relationship a mounting member on each of the edges which is easily secured to a support and is readily adaptable for retention with adjacently positioned panels of like construction.

It is another and further, more specific object of the invention to provide a panel construction of fire resistive character which has an exterior decorative surface.

It is still another object of the invention to provide a wall panel construction of fire-resistive quality comprised of staggered, horizontal panels.

These and further objects of the invention will become apparent from the hereinafter following commentary taken in conjunction with the drawings.

Basically in one embodiment, the invention pertains to a panel construction comprising the combination of a first elongate panel of wall construction material having first and second opposed lateral edges. A female elongate mounting member is secured substantially and coextensively along at least one of said first and second opposed lateral edges with the female elongate mounting member comprising a channel-like configuration with first and second opposed flanges and an integral intermediate connecting web portion. The web portion has an intermediate groove and the first and second flanges matingly engaged opposed surfaces of the first elongate panel in an edge reinforcing manner. A second elongate panel having first and second opposed lateral edges has a male elongate mounting member secured substantially and coextensively along at least one of said first and second opposed lateral edges with the male elongate mounting member comprising a channel-like configuration with first and second opposed flanges and an integral connecting web portion having an intermediate tongue adapted to matingly nest within the groove of said female mounting member of said first elongate panel. The opposed flanges of the female and male mounting members matingly engage the respective opposed surfaces of the respective first and second elongate panels in an edge reinforcing manner. The male and female supporting members are adapted for rigid securement to a wall or ceiling support surface or other structure. A covering or other decorative layer may overlie at least the one exposed surface of the first and second elongate panels and the flanges of the female and male mounting members respectively secured thereto.

Other objects and advantages of the invention will be apparent from the following specification and the accompanying drawings which are for the purpose of illustration only.

DESCRIPTION OF THE BEST EMBODIMENT CONTEMPLATED

Figures 1, 2, 3, 4:
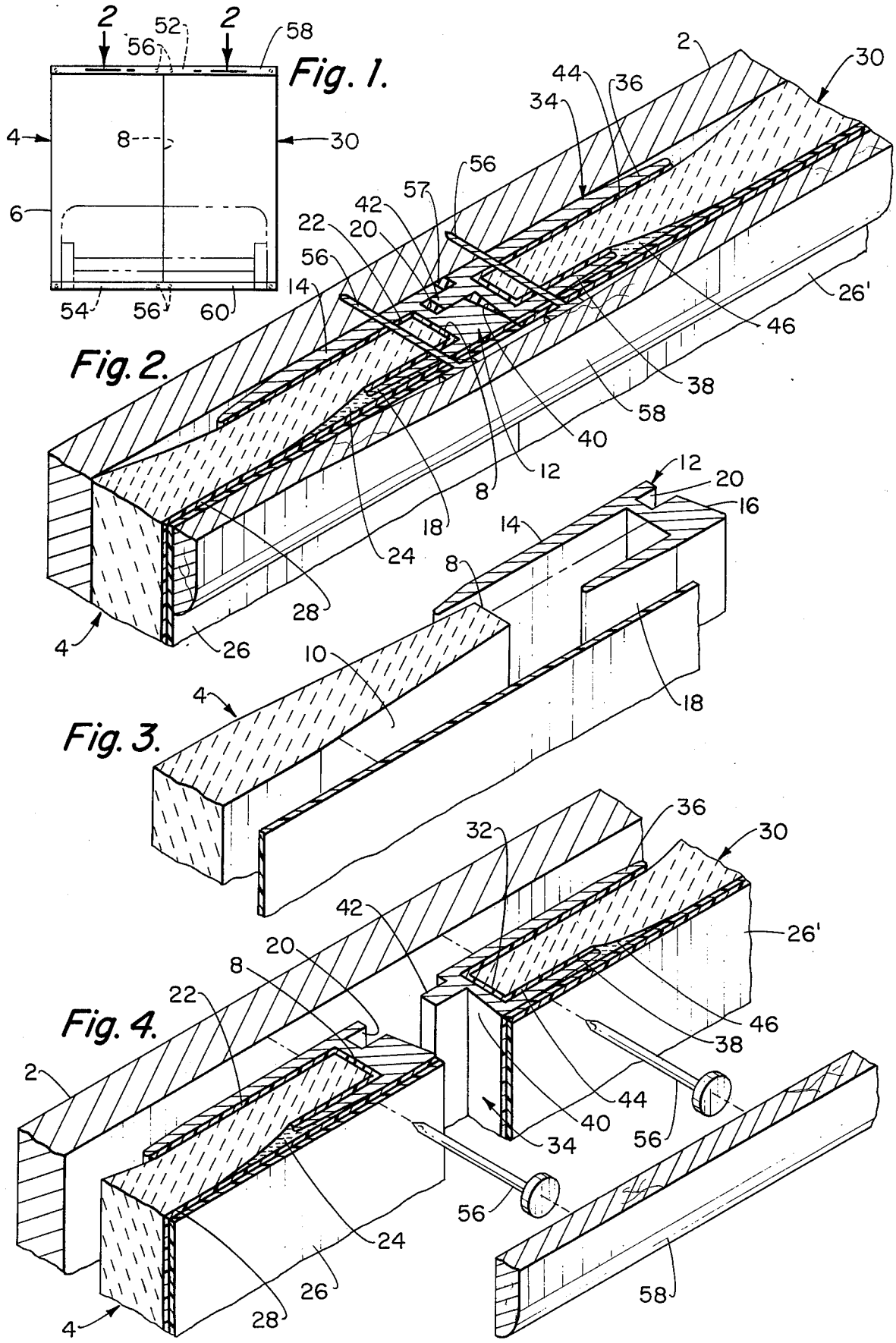
FIG. 1 is a schematic illustration of one embodiment of the invention showing the interior of a room or the like utilizing the elongate panels of this invention.
FIG. 2 is an enlarged, fragmented view taken along the line 2—2 of FIG. 1.
FIG. 3 is an exploded view showing one of the panel constructions to which the female mounting member is secured.
FIG. 4 illustrates one embodiment of the panel of this invention being readied for adjacent positioning as a wall panel with another like wall panel and the manner in which erection of the wall panels into a wall is effected.

Referring to the figures of drawings wherein like numerals of reference designate like elements throughout specific embodiments of the panel constructions of this invention are illustrated.

It should be understood that the description will proceed in the main for one panel and that the other panels that are adjacently positioned and erected to coact with the panel described effectively form an interior wall or ceiling surface. Also while one specific mode of mounting the individual panels of the invention will be described, it should be understood that other means of mounting and indeed, the support to which they are mounted, are matters of ordinary skill in the art which will at once present themselves to workers in the art.

Referring to FIGS. 1–4 of the drawings, a wall support structure 2 is provided as in customary in the housing art and in this particular instance a first panel 4 having opposed vertical edges 6 and 8 is ideally, but not necessarily, of a fire resistive construction being of gypsum or the like.

One type of panels contemplated for application of the herein-disclosed invention are those that are normally fabricated for the usual gypsum board-type of prevailing, wall construction. In the conventional sense, these gypsum board, formed panels have a taper for opposed edges so that once the panels are nailed in place, an adhesive or other type of tape may be placed over the butting seam and spackle or other filler applied to cover over the nail holes and tape to provide a smooth, flush wall surface. Thus, the invention will be described as it specifically applies to existing gypsum wall panels, it being understood, as will be seen hereinafter, that completely planar or square gypsum wall panels may also be utilizable in carrying out the invention, as well as other modified gypsum panels in order to fully obtain the attributes of the invention.

A gypsum wall panel 4, having a tapered edge as at 10, has an adhesive such as epoxy or any of the other well-known construction adhesives applied to the edge 8. A female mounting member 12 in this instance of extruded aluminum, is positioned along the entire vertical edge 8. The female mounting member 12 has a channel-like construction having a flange 14, an intermediate web 16 and an opposed flange 18. The female supporting member 12 extends the entire length of the vertical edge 8 of panel 4. The panel 4 may be of any conventional size, but in this particular instance, the wall panels may be 4 ft. × 8 ft. In the intermediate, integral connecting web 16 is provided an elongate groove 20 for pusposes which will become apparent. It will be noted that epoxy resin adhesive or other glue-type material 22 (FIG. 4) secures female member 12 to the one vertical edge 8 of panel 4. In order to compensate for the taper in panel 4 as at 10, a spackle, paste or the like 24 is provided so as to form a flush or planar coincidence between the surface of flange 18 and the remainder of the surface of panel 4. Over the surface of the panel and the surface of the flange 18 may be secured a decorative wall covering 26 by means of adhesive 28.

It should be understood that the panel 4 would have applied to the opposite edge (not shown) a male supporting member for coaction with an adjacently positioned, similarly construction panel. However, for purposes of description this construction for the opposed vertical edge of panel 4 will now be described with respect to wall panel 30 which again is of the same material of construction as previously described for panel 4. Secured to the vertical edge 32 is male support member 34, in this instance also comprising an elongate channel-like configuration having opposed flanges 36 and 38 with an intermediate integral web portion 40 having a protuberance or tongue projection 42 to be received into the groove 20 of female support member 12.

As was the case with regard to panel 4, an adhesive material is applied to the interior flanges of male support member 34 (and which adhesive layer is designated 44) for proper securement to the panel 30. As was the case with regard to panel 4, an amount of spackle or the like 46 is applied to make the flange surface 38 co-planar with the remainder of the surface of panel 30. To the exterior surface of panel 30 and the exterior of flange 38 may be applied the decorative wall covering 26' in the same manner as was done with respect to wall panel 4. Known adhesives may be used.

It will be seen that both the female support member 12 and the male support member 34 when applied to opposed edges of wall panel 4, for example, provide substantial reinforcement to the edges because of the opposed flanges intermediately receiving the edge portion of the wall panels with which the support members are associated.

Figure 5:
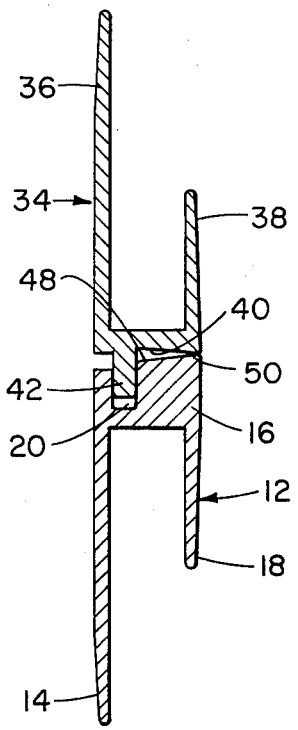
FIG. 5 illustrates one embodiment of the mounting members of this invention.

Referring to FIG. 5, it will be seen that the female support member has a groove or recess 20 of greater depth than tongue 42 of male support member 34. This is to provide flush fitting of adjacently positioned panels and also to allow disposition of an epoxy, resin, glue or adhesive in order to aid in rigidly supporting the panels in place as shown in FIG. 1. Additionally, the wall support female member 12 has the interior flange 14 of greater dimension than the opposed flange 18 and the intermediate web portion 16 has a slight incline as at 48 to insure snug, abutting fit of adjacently positioned panels so that the male and female support members 34 and 12, respectively, are almost indiscernible to the naked eye once the wall panels have been erected in the manner illustrated in FIG. 1. The intermediate integral web 40 of male support member 34 is provided with a slightly angular surface 50 to insure proper abutting fit of the adjacently positioned wall support members 34 and 12 and the wall panels to which they are secured.

Figure 7:
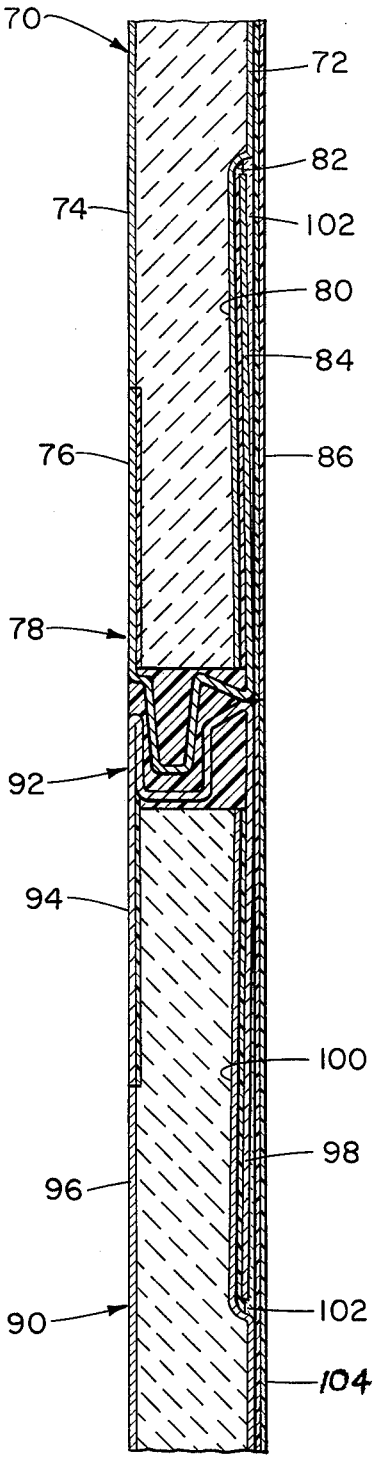
Figure 8:
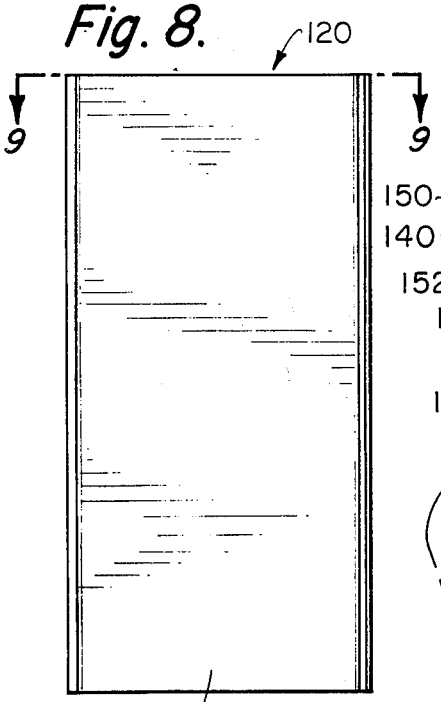
FIG. 8 illustrates still another embodiment of the invention which may be used as wall or ceiling panels.

Obviously, workers in the art will recognize that panels as shown and described do not require the tapered surface as, for example, at 10 for panel 4 but may be squared off, which thereby obviates the need of a spackle filling, for example 24 or 38 (FIG. 4); or alternately the panel may take the form shown in FIG. 7. Those of ordinary skill in the art will at once recognize the slight modification to the practice of the invention where such gypsum boards are manufactured as immediately described above and as later described.

Figure 6:
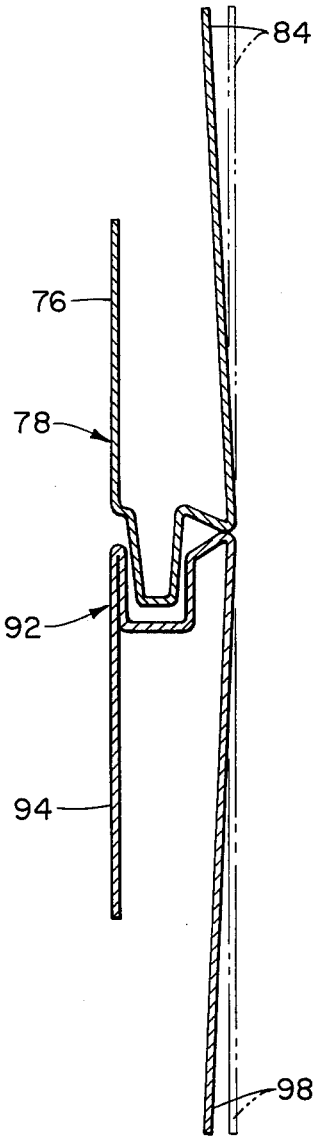
FIGS. 6 and 7 illustrate another embodiment of the invention.

Referring now to FIGS. 6 and 7, an alternate embodiment will be described. In this instance the gypsum panel 70 has paper covers 72 and 74 as is common in this type of panel. The paper cover 74 is shortened by about the length of depth of the inner flange 76 of male mounting members 78 which in this instance, is of rolled steel construction. The thickness of paper cover 74 is approximately the same thickness as the flange 76.

Prior to placement of male member 78 onto the gypsum board panel 70, the exterior surface has been rolled to form a planar recess or surface 80 and a slight radiused portion 82 to receive the outer flange 84 of male mounting member 78. Obviously, the radiused portion 82 may be made square if production facilities permit.

Because the flange 84 is of metal and is inwardly disposed with respect to a plane (FIG. 6), a clamping or biasing action is imparted to male member 78 to retain same on the edge of panel 70. This is especially helpful in securing the member 78 to panel 70. The slight depression between the remainder of panel 70 and the flange 84 is filled with a filler, for example, such as spackle and a flush, planar configuration obtained to receive the wall covering 86. Obviously, the covering 86 may be disposed with where the panel is to be finished with a texturized paint or other covering.

The other panel 90 has secured to it female mounting member 92. The inner flange 94 is flush with the paper cover 96 of panel 90. Likewise, the outer flange 98 is inwardly disposed with respect to a plane (FIG. 6) as earlier described for the male mounting member 78.

The outer surface of panel 90 is also provided with the planar recess 100 to receive the outer flange 98 as earlier described with respect to the male mounting member 78. A filling 102 provides a flush, planar surface to receive wall covering section 104.

The same criteria that is disclosed above with respect to the mating engagement of wall panel support members 12 and 34 apply also to the member 78 and 92 except as has obviously been noted otherwise. That is the tongue and groove portions of member 78 and 92 are such as to receive adhesive therebetween and are adapted to be securely retained on the edges of panels for ease of erection into finished walls.

After one of the panels, 4, for example, has had secured thereto the male and female supporting members in the manner hereinbefore described, the panel is placed against the wall support structure, 2, for example, and nailed in place at the top 52 and bottom 54 (FIG. 1) by means of, for example, nails 56. The nail 56 is driven through the exterior decorative layer 26; through the aluminum flange of the female support member; through the gypsum panel 4 and thence through the opposed opposite flange of the female support member and into the wall support structure 2.

Similarly, a finished panel 30 is positioned adjacent the erected panel 4 after an adhesive has been placed either in the groove 20 of female support member 14 or alternately disposed on the protruding tongue 42 of male support member 34. The adhesive 57 (FIG. 2) is thus disposed in the space between the web portions of the male and female members and in the unoccupied portion of groove 20 to form a secure adhesive bond between adjacently positioned panels. Finally, the nail 56 is driven through the adjacently positioned panel 30 (FIG. 2) to provide additional securement for the erected wall panels.

Thereafter, similarly constructed panels are put in mating engagement, one next to the other, to form an erected wall as illustrated in FIG. 1. Thereafter, a molding strip such as, for example, 58 is placed along the top edge of the panel construction and a molding 60 placed along the bottom of the erected wall to cover over and conceal the nails 56 driven through the panels to provide securement to the wall support structure.

Referring to FIGS. 8–11 inclusive, a panel construction 120 is illustrated which may be utilized for horizontal erection as a ceiling or vertical erection as a wall surface. The individual panel 122 has opposed lateral edges 124 and 126 having on the exterior surface 128 and 130 respectively, a recess or taper to receive the opposed flanges of female mounting member 132 and male mounting member 134.

Figure 9:
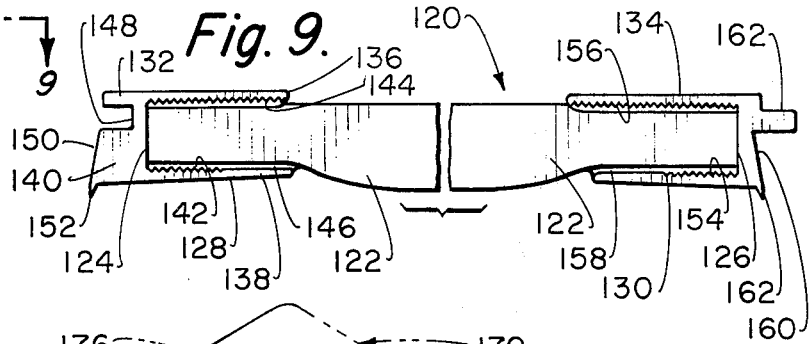
FIG. 9 is a view taken along the line 9—9 of FIG. 8.
Figure 10:
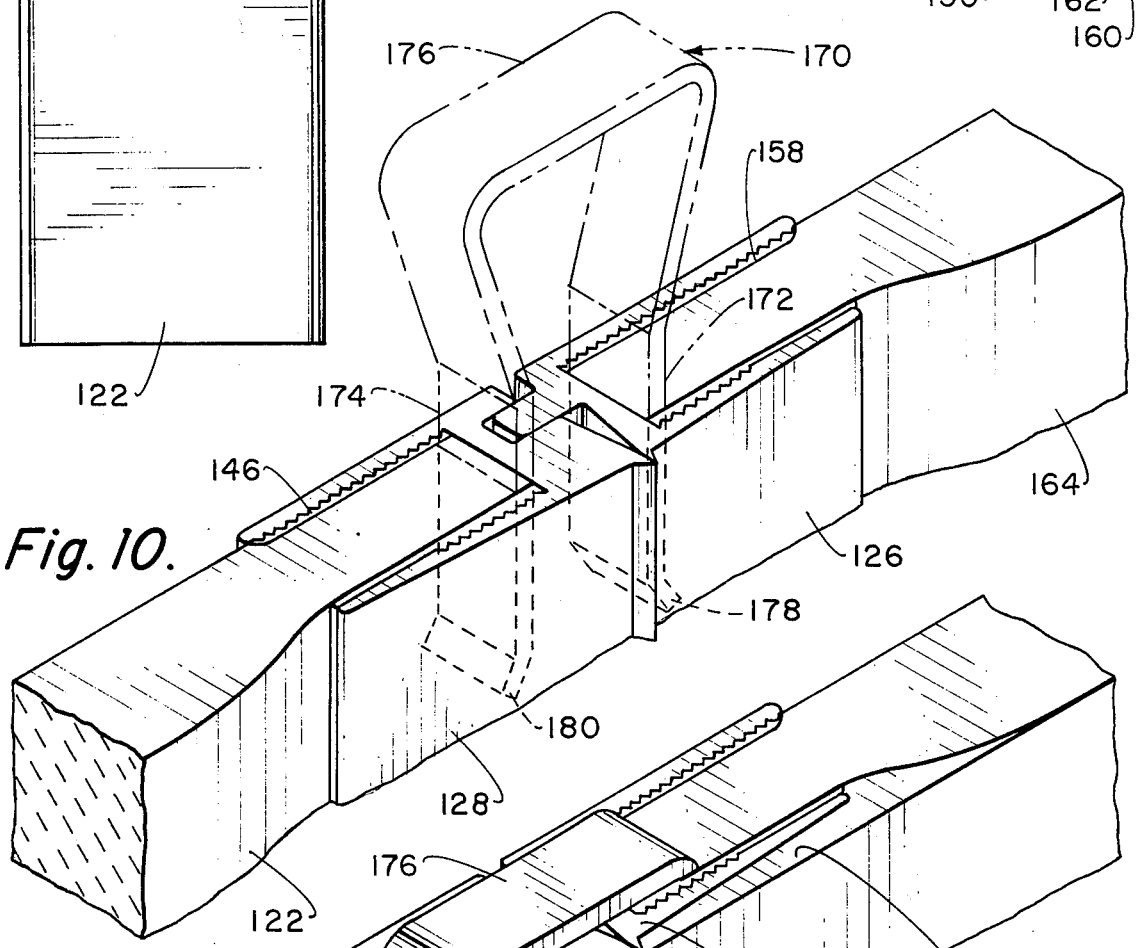
FIG. 10 is an enlarged, fragmented view of an adjacently positioned wall or ceiling panels of this invention.

The female mounting member 132, like the mounting members previously described, is of channel configuration having opposed flanges 136 and 138 with an intermediate web portion 140. The flange 138 is approximately or slightly longer than the opposed flange 136 and has a portion of its interior surface 142 grooved or serrated for purposes which will become apparent. The interior surface 144 of flange 136 is entirely grooved or serrated so as to form a better bond between the female mounting member 128, the adhesive layer 146 and the elongate panel 122. The female mounting member 128 has intermediate web portion 140 with slot 148 adjacently positioned and inwardly directed from the approximate midpoint of intermediate connecting web 140 as shown in FIG. 9. The exterior surface 150 of intermediate web portion 140 has an outwardly directed configuration terminating in a protruding or slightly raised lip 152 for purposes which will be described hereinafter.

The male mounting member 126 has the exterior flange 130 of slightly lesser dimension than the flange 134 and the interior surface of flange 130 at 154 is serrated or grooved as in the interior surface 156 of flange 134 also to provide adequate bonding between the panel 122 and the male mounting member 126 by means of adhesive layer 158. The intermediate connecting web 160 of male mounting member 126 has a protruding tongue 162 adapted to cooperate with the slot or groove 148 of female mounting member 128. The exterior surface of intermediate web portion 160 is outwardly directed or flared and terminates in protrusion or lip 162 similar to the lip 152 of female mounting member 128.

Figure 11:
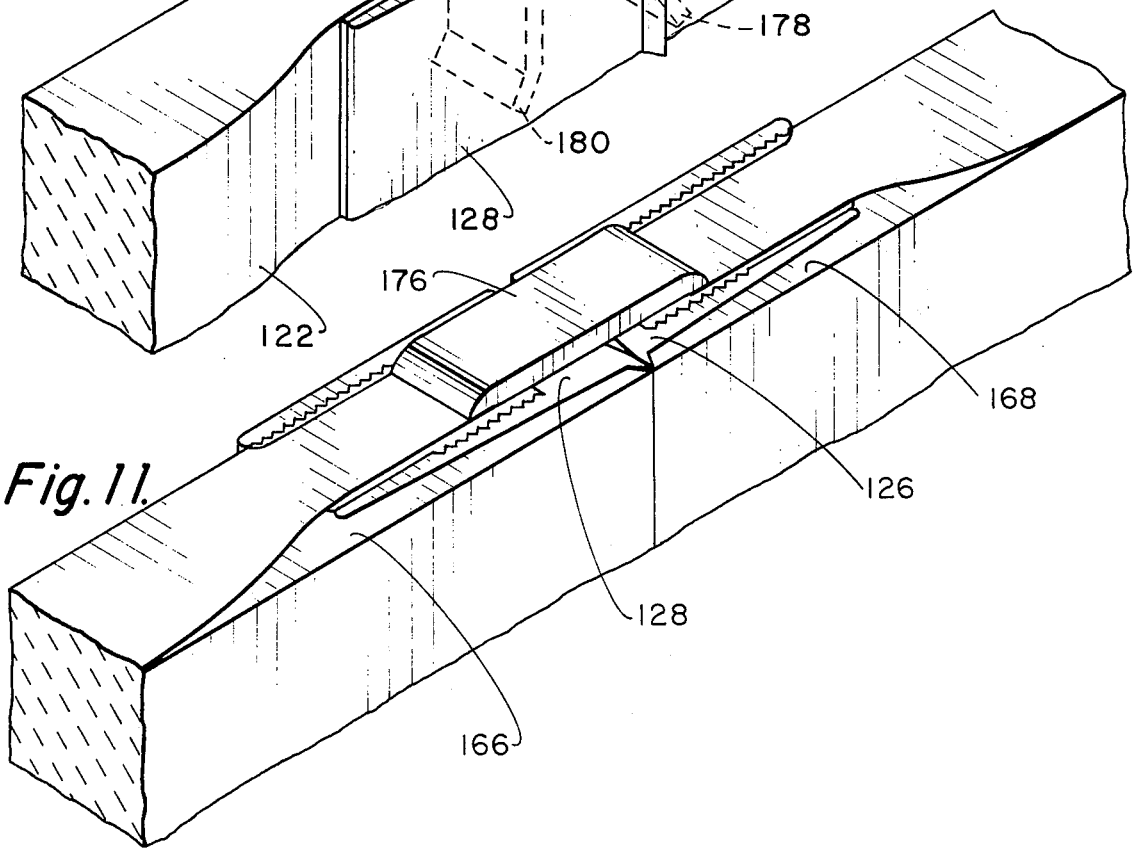
FIG. 11 illustrates the panels of FIG. 10 ready for vertical or horizontal placement.

In this particular embodiment of the invention, panels such as 122 and 164 are performed at a factory site having the female mounting member 128 and the male mounting member 126 adhesively secured thereto. The individual panels 122 and 164 with the secured mounting members on the lateral edges thereof are provided with a spackle fill 166 and 168 from the lips 152 and 162 of female mounting member 128 and male mounting member 126 respectively. This then provides a planar surface to the exterior of the individual panels 122 and 164 which may subsequently be erected into a ceiling or wall surface structure.

Where the panels of this embodiment are to be provided with a texturized paint coating, they need not have anything further done to them for erection on the prefabricated housing assembly line or on-the-job site. In such event, workmen would merely place the panels 122 and 164 in position and drive securement means at each end of the abutting panels in order to hold adjacently positioned panels in secure relationship. In this respect, U-shaped clips 170 having depending legs 172 and 174 and intermediate cross-bar 176 may be utilized. It will be noted that the terminal 178 and 180 of depending legs 172 and 174 respectively, are outwardly flared so that surface-to-surface contact is obtained between the interior surface of clip 170 and the interior surfaces of the intermediate connecting webs of female mounting member 128 and male mounting member 126. The U-shaped clip 170 is driven into the panel ends by means of a hammer or the like so as to assume the flush position as shown in FIG. 11. The workmen may then place two, three or four similarly secured panels into position as either a ceiling or a wall and thereafter secure the assembled panels to a ceiling or wall support structure by means of nails, staples or similar such securement means not shown.

Where it is desired to provide a vinyl or other covering on the embodiment of the invention shown in FIGS. 8–11 inclusive, this coating is placed on the panels during fabrication of the individual panels and the covering would be similar to that described and illustrated for the other embodiments of the invention and not shown in FIGS. 8–11 inclusive. Where the panels of this embodiment are to be utilized as a ceiling, a texturized paint or other coating may be applied to the exterior surface of the panels to thereby cover over nail staple holes and even the abutment seam formed by adjacently positioned panels. Where a wall covering or the like is utilized, a mixture of the wall covering and an adhesive may be utilized to fill in staple or nail holes and where the wall covering is texturized the nail or staple holes become practically indiscernible as does the abutment seam of the adjacently positioned panels.

Figure 12:
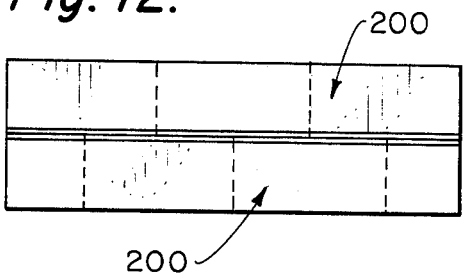
FIG. 12 is a schematic illustration of another embodiment of the invention showing the interior of a room or the like utilizing elongate panels that are horizontally placed in staggered relationship.

Referring to FIG. 12 et seq. a particularly desirable wall construction will be detailed, one that has passed a fire test in order to be rated at least a one hour fire wall type of construction. In this particular wall panel construction which is diagrammatically illustrated in FIG. 12, it will be noted that a wall is fabricated of individual panels 200 in this instance approximately 2 feet by 4 feet being rectangularly shaped and composed of a typical gypsum board conventionally found having a gypsum core 202 with opposed surfaces having paper layers 204 and 206 adhered thereto.

Figure 13A:
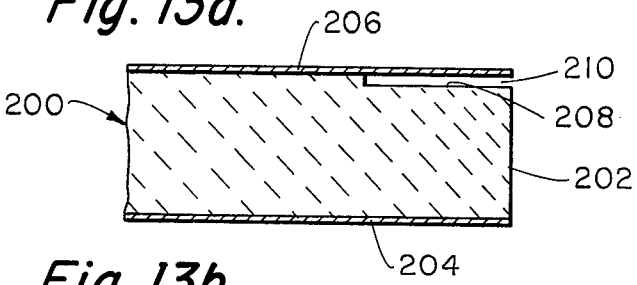
FIG. 13*a* is an enlarged view of the edge portion of a gypsum panel modified and utilized in the invention shown in FIG. 12.
Figure 13B:
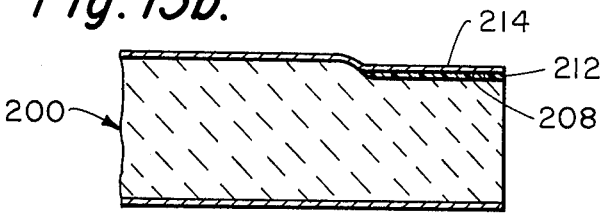
FIG. 13*b* is an enlarged view of the FIG. 13*a* panel after modification for use in the structure shown in FIG. 12.

Referring to FIG. 13*a*, the conventional gypsum board is modified in accordance with this invention by cutting the short edges for, example, 208 adjacent the paper layer 206 in order to form a slot 210 which is approximately 1/20,000 inch thick to a depth of approximately ½ inch. Once the undercut or slot 210 has been formed, an adhesive such as 212 is positioned along the entire lateral edge 208 of the panel 200 and thereafter the panel 200 is subjected to a roller along the edge 208 so as to deform the surface of the gypsum panel 200 as illustrated in FIG. 13*b*. This then forms what may be considered a recess portion 214 along the edge 208 of panel 200. Both short edges of panel 200 are thusly provided with a ½ inch wide recessed area.

In this particular instance, the panels 200 have each of the short or lateral edges worked upon as discussed and as shown in FIGS. 13*a* and 13*b*. Deviating from the hereinbefore disclosed embodiments of the invention, the panels 200 are provided on only one long edge, for example, 216 with a male or female mounting member 218 of the type heretofore disclosed, while an adjacently positioned panel is provided with the complimentary mounting member such as 220, it either being male or female depending upon selection for the mounting member 218. As previously disclosed, the mounting members are adhesively secured but only to one edge of the individual panels 200 comprising the wall structure as illustrated in FIG. 12.

Figure 14:
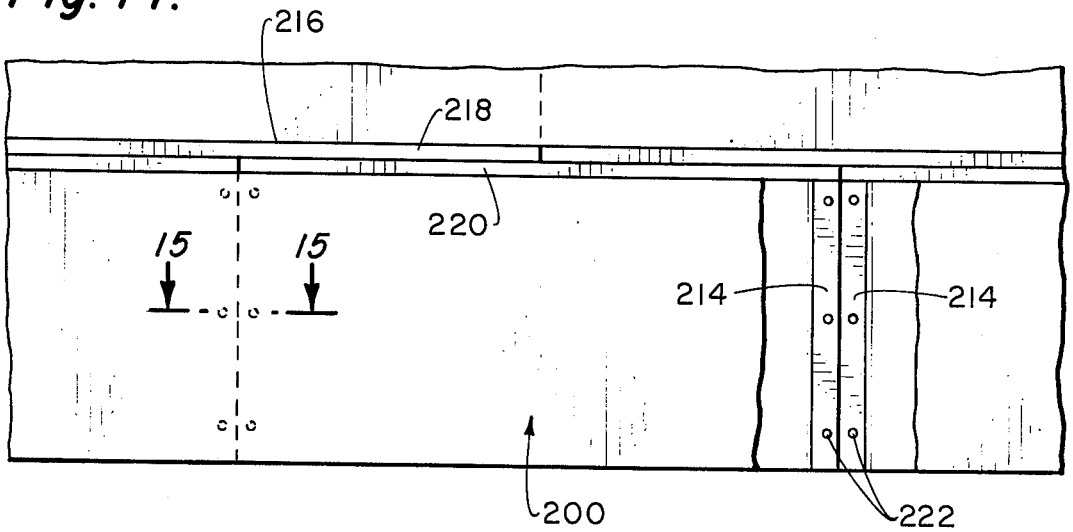
FIG. 14 is an enlarged view of the structure shown in FIG. 12 with portions removed to show the specifics of construction.
Figure 15:
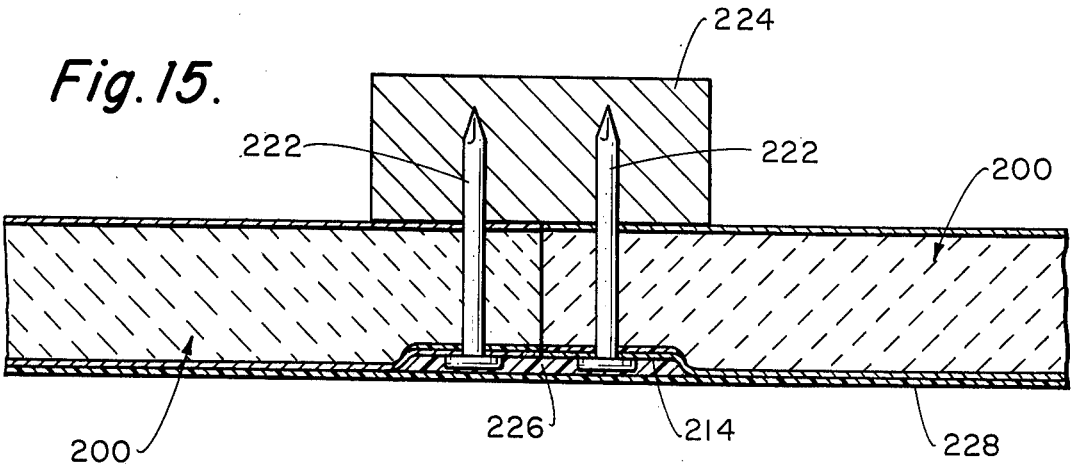
FIG. 15 is an enlarged view taken along the line 15—15 of FIG. 14.

The panels are placed in the position shown in FIG. 14 in staggered relationship best seen in FIG. 12 and securement means such as nails 222 utilized to secure the panels in staggered relationship to, for example, furring strips or other support structure 224. It will be noted that the nails 222 are placed within the recess area 214 of the panels 200 in spaced relationship so as to adequately secure the individual panels 200 making up the wall structure.

A spackle layer is then placed within the recesses 214 of adjacently positioned panels 200 so as to fill the recesses to approximate flush or planar relationship with the remainder of the panels 200 adjacent the recesses 214. The spackle layer 226 is feathered in a manner well-known and conventional in this particular art so as to obtain substantial planar relationship of the recess portions 214 with regard to the adjacent remainder surfaces of the individual panels 200.

The wall thus erected either in place or on factory site is subsequently provided with a texturized paint coating 228 or other type of decorative layer, whether it be vinyl, paper or otherwise, as previously disclosed with regard to the other embodiments of the invention.

Thus, there has been disclosed an economically feasible fire resistive panel construction for utilization in the prefabricated housing field and a panel construction which may be utilized in existing housing for remodeling and the like purposes.

There are changes and modifications to the herein-disclosed invention which will at once make themselves apparent and obvious to those of ordinary skill in the art, and all such changes and modifications are intended to be covered by the appended claims.

For example, the male and female members may be of rolled steel of any other metal as opposed to extruded aluminum. Additionally, the terminal edges of the exteriorly exposed flanges of both the male and female members, i.e., 34 and 18 respectively, may be of thin wall configuration (in the range of 0.015 inch) so as to be flush with the exterior surface of the panels with which the members are associated, thereby obviating the need of a filler such as spackle or the like.

Additionally, in lieu of a wall paper, vinyl or other wall covering, the panels of this invention may have wood veneer or texturized paint or other decorative coating adhered thereto. Regardless of the type of decorative covering, the non-planar configuration of the intermediate web portions of the male and female members makes it possible to trim the covering to close tolerances without cutting, nicking or otherwise scoring the web portion itself, where coverings of the plastic or wall paper type are utilized.

In instances where a texturized vinyl covering has been applied to the preformed panels, a paste mix of covering and adhesive may be utilized to cover or fill in nail or staple holes utilized to secure the panels to the underlying support structure. Where texturized paint is utilized, the seams of abutting panels and nails or staples are covered over to provide an indiscernible joint for wall or ceiling surfaces.

Thus, a fire-resistive panel construction has been disclosed, which because of the interlock between the male and female members of the structure, provides additional fire-resistive characteristics to the final wall or ceiling assembly over and above that which would be obtained where the panels merely abutted along an edge. Obviously, the metal material of the cooperative male and female members provides protection to the panel support structure which would otherwise not be available.

I claim:

1. A panel construction comprising the combination: a first elongate panel of gypsum core construction material having first and second opposed lateral edges; a female elongate mounting member secured substantially coextensively along one of said first and second opposed lateral edges, said female elongate mounting member comprising a channel-like configuration with solid, continuous wall first and second opposed flanges and an integral, intermediate connecting web portion; said web portion having an intermediate groove, the confronting surfaces of said first and second flanges having a plurality of grooves therein and matingly engaging opposed surfaces of said first elongate panel in an edge reinforcing manner; a male elongate mounting member secured substantially and coextensively along the other of said first and second opposed lateral edges, said male elongate mounting member comprising a channel-like configuration with solid, continuous wall first and second opposed flanges and an integral, connecting web portion having an intermediate tongue adapted to matingly nest within the groove of said female mounting member of a secondly positioned elongate panel, the confronting surfaces of said opposed flanges of said male mounting members having a plurality of grooves therein and matingly engaging opposed surfaces of said first elongate panel in an edge reinforcing manner, said male and female elongate mounting members being adapted for rigid securement to a support surface.

2. The panel construction in accordance with claim 1 including a covering overlying at least one surface of said first elongate panel and the flanges of the female and male mounting members secured thereto.

3. The panel construction in accordance with claim 2 wherein the elongate groove in said female member is of a greater dimension than the tongue in said male support member so as to telescopically receive said tongue.

4. The panel construction in accordance with claim 3 wherein said tongue of said male mounting member is sufficiently extending and protruding to be received in the groove of said female mounting member in securing coaction therewith.

5. The panel construction in accordance with claim 4 wherein said intermediate, connecting web portion of said male mounting member adjacent at least said tongue is non-planar and angles inwardly from the terminus of said tongue.

6. The panel construction in accordance with claim 5 wherein said intermediate, connecting web portion of said female mounting member adjacent at least said intermediate groove is non-planar and angles outwardly from the mouth of said intermediate groove.

7. The panel construction in accordance with claim 6 wherein said flanges of said male and female mounting members, adapted to be exteriorly positioned of said panels, terminate in an elongate, outwardly directed lip adjacent said intermediate connecting web portions of said male and female mounting members.

8. The panel construction in accordance with claim 7 wherein said tongue of said male mounting member and said groove of said female mounting member are inwardly offset from the respective mid-points of said intermediate, connecting web portions thereof.

9. The panel construction in accordance with claim 8 including panel end securing members comprising U-shaped clips driven into the opposed edges, adjacent said lateral edges, of adjacent panels.

10. The panel construction in accordance with claim 9 wherein said U-shaped clips have the opposed legs thereof inwardly directed from the cross-bar thereof and abut the interior surfaces of said intermediate connecting web portions of said male and female mounting members, and said first and second elongate panels have recessed surfaces adjacent said lateral edges to receive said flanges of said male and female mounting members.

11. The panel construction in accordance with claim 3 wherein the intermediate web surface of said female mounting member forms an abutment for said male mounting member and is configured to permit retention of an adhesive layer therein so that the positioned edge surface of the intermediate web of said male member does not have coextensive planar contact therewith.

12. The panel construction in accordance with claim 11 including a decorative covering layer wherein the flange of said male mounting member secured to the exterior of the panel to which the decorative layer is applied is longer than the opposed flange thereof.

13. The panel construction in accordance with claim 12 wherein the exterior flange of said female mounting member to which is secured said decorative covering layer is shorter than the opposed flange thereof.

14. The panel construction in accordance with claim 13 wherein the flange portions of the male and female mounting members to which is applied the decorative covering layer have inclined surfaces.

15. The panel construction in accordance with claim 8 wherein the panels have at least one surface which is tapered and a spackle-type of material is applied to the panel to make the exterior surface thereof substantially planar with the flanges of said male and female mounting members.

16. The panel construction in accordance with claim 15 wherein said male and female mounting members are of metal and wherein an adhesive layer is positioned between the tongue of said male member and the groove of said female member and said panels are of fire-resistive material and are adapted for vertical placement to form a wall structure.

17. Interior building construction comprising the combination: a first elongate panel of gypsum core construction material having first and second opposed lateral edges; a female elongate mounting member secured substantially and coextensively along at least one of said first and second opposed lateral edges, said female elongate mounting member comprising a channel-like configuration with solid, continuous wall first and second opposed flanges and an integral, intermediate connecting web portion; said web portion having an intermediate groove, the confronting surfaces of said first and second flanges having a plurality of grooves therein and matingly engaging opposed surfaces of said first elongate panel in an edge reinforcing manner; a second elongate panel of gypsum core construction having first and second opposed lateral edges; a male elongate mounting member secured substantially and coextensively along at least one of said first and second opposed lateral edges of said second elongate panel, said male elongate mounting member comprising a channel-like configuration with solid, continuous wall first and second opposed flanges and an integral, connecting web portion having an intermediate tongue adapted to matingly nest within the groove of said female mounting member of said first elongate panel when adjacently positioned thereto, the confronting surfaces of said opposed flanges of said male mounting member having a plurality of grooves therein and matingly engaging opposed surfaces of said second elongate panel in an edge reinforcing manner, said male and female elongate mounting members being adapted for rigid securement to a support surface.

18. The construction in accordance with claim 17 wherein said first and second elongate panels are horizontally positioned in staggered relationship with said female mounting member adjacent said male mounting member and said tongue of said male mounting member matingly nesting in the groove of said female mounting member.

19. The construction in accordance with claim 18 wherein said first and second panels are rectangular and said female and male mounting members are secured along the adjacent long edges of said panels.

20. The construction in accordance with claim 19 wherein the opposed short edges of said first and second elongate panels have recessed portions along their short edges.

21. The construction in accordance with claim 20 including support structure to which said first and second panels are secured.

22. The construction in accordance with claim 21 wherein said panels are formed of a gypsum core material having paper layers on the opposed planar surfaces thereof.

23. The construction in accordance with claim 22 wherein said recessed portions are characterized by the partial absence of gypsum core material from one surface thereof, said paper layer on said surface being bonded to the remainder of said gypsum core material in said recess.

24. The construction in accordance with claim 23 wherein said recessed portions of said first and second elongate panels are adjacently positioned.

25. The construction in accordance with claim 24 including additional elongate panels of like construction to said first and second elongate panels erected and secured to said support structure to form a wall.

26. The construction in accordance with claim 25 wherein said male and female mounting members are adheringly secured to said first, second, and additional elongate panels and securement means to rigidly secure said panels to said support structure are placed in and through said recessed portions in spaced relationship.

27. The construction in accordance with claim 26 wherein said securement means comprise nails or staples.

28. The construction in accordance with claim 27 including a layer of filler material covering said recessed portions whereby said securement means is covered over.

29. The construction in accordance with claim 28 including a decorative layer overlying the exposed surfaces of said first, second and additional elongate panels.

30. The construction in accordance with claim 29 wherein said decorative layer comprises paint.

31. The construction in accordance with claim 30 wherein said paint layer is texturized.

32. The construction in accordance with claim 29 wherein said decorative layer comprises vinyl material.

33. Securement means for securing panels comprising a female elongate mounting member adapted to be secured to an edge of a panel and comprising a channel-like configuration with solid, continuous wall first and second opposed flanges and an integral, intermediate connecting web portion; said web portion having an intermediate groove, the confronting surfaces of said first and second flanges having a plurality of grooves therein and being adapted to matingly engage opposed surfaces of said panel in an edge reinforcing manner; a male elongate mounting member adapted to be secured substantially and coextensively along another edge of the same or different panel and comprising a channel-like configuration with solid, continuous wall first and second opposed flanges and an integral, connecting web portion having an intermediate tongue adapted to matingly nest with the groove of said female mounting member, the confronting surfaces of said first and second opposed flanges having a plurality of grooves therein and being adapted to matingly engage opposed surfaces of said same or different panel in an edge reinforcing manner.

34. The securement means in accordance with claim 33 wherein the elongate groove of said female mounting member is of greater dimension than the tongue in said male mounting member so as to telescopically receive said tongue.

35. The securement means in accordance with claim 34 wherein the flanges of each of said male and female mounting members extend sufficiently beyond the edges of the panel to which they are adapted to be secured so as to provide reinforcement to the edges of the panel.

36. The securement means in accordance with claim 35 wherein the intermediate web surface of said female support member is non-planar with respect to the intermediate web portion of said male mounting member so as to provide a space therebetween to prevent total surface-to-surface mating engagement of the end portions of said male and female mounting members when same are in cooperative securing relationship.

37. The securement means in accordance with claim 36 wherein the tongue of said male support member extends and protrudes sufficiently into the receiving groove of said female support member so as to provide securing coaction between said male and female support members.

38. The securement means in accordance with claim 37 wherein the flange of said male mounting member opposite the surface of said panel which is to be exteriorly exposed is of greater dimension than the opposed flange adjacent said panel surface which is to be exteriorly exposed.

39. The securement means in accordance with claim 38 wherein said groove of said female mounting member is inwardly spaced from said flange which is exteriorly exposed and wherein said tongue of said male mounting member is inwardly spaced from said flange which is exteriorly exposed.

40. The securement means in accordance with claim 39 wherein said flanges of said male and female mounting members adapted to be exteriorly positioned of said panels, terminate in an elongate, outwardly directed lip adjacent said intermediate connecting web portion of said male and female mounting members.

41. The securement means in accordance with claim 40 wherein said tongue of said male mounting member and said groove of said female mounting member are inwardly offset from the respective mid-points of said intermediate connecting web portions thereof.

42. The securement means in accordance with claim 41 wherein a portion of the interior surfaces of said flanges of said male and female mounting members are grooved.

43. The securement means in accordance with claim 42 wherein the flange of said female mounting member opposite the surface of the wall panel which is to be exteriorly exposed is longer than the flange adjacent the exteriorly exposed wall surface.

44. The panel construction in accordance with claim 43 wherein the flanges of said male and female members adapted to be outwardly disposed with respect to said support surface are inwardly directed to provide a clamping action with respect to said mounting members and the edges of said panels with which they are associated.

45. A panel construction comprising the combination: a first elongate panel of gypsum core construction material having first and second opposed lateral edges; a female elongate mounting member secured substantially and coextensively along one of said first and second opposed lateral edges, said female elongate mounting member comprising a channel-like configuration with continuous wall first and second opposed flanges and an integral, intermediate connecting web portion; said web portion having an intermediate groove, said first and second flanges matingly engaging opposed surfaces of said first elongate panel in an edge reinforcing manner; a male elongate mounting member secured substantially and coextensively along the other of said first and second opposed lateral edges, said male elongate mounting member comprising a channel-like configuration with continuous wall first and second opposed flanges and an integral, connecting web portion having an intermediate tongue adapted to matingly nest within the groove of said female mounting member of a secondly positioned elongate panel, said opposed flanges of said male mounting members matingly engaging opposed surfaces of said first elongate panel in an edge reinforcing manner, said male and female elongate mounting members being adapted for rigid securement to a support surface; and panel end securing members comprising U-shaped clips driven into the opposed edges, adjacent said lateral edges, of adjacent panels.

46. The panel construction in accordance with claim 45 wherein said U-shaped clips have the opposed legs thereof inwardly directed from the cross-bar thereof and abut the interior surfaces of said intermediate connecting web portions of said male and female mounting members, and said first and second elongate panels have recessed surfaces adjacent said lateral edges to receive said flanges of said male and female mounting members.

47. Interior building construction comprising the combination: a first rectangular panel of gypsum core construction material with paper layers on the opposed planar surfaces thereof and having first and second opposed long edges and first and second opposed short edges; a female elongate mounting member secured substantially and coextensively along at least one of said first and second opposed long edges, said female rectangular mounting member comprising a channel-like configuration with continuous wall first and second opposed flanges and an integral, intermediate connecting web portion; said web portion having an intermediate groove, said first and second flanges matingly engaging opposed surfaces of said first rectangular panel in an edge reinforcing manner; a second rectangular panel of gypsum core construction having first and second opposed long edges; a mal elongate mounting member secured substantially and coextensively along at least one of said first and second opposed long edges of said second rectangular panel, said male elongate mounting member comprising a channel-like configuration with continuous wall first and second opposed flanges and an integral, connecting web portion having an intermediate tongue adapted to matingly nest within the groove of said female mounting member of said first rectangular panel when adjacently positioned thereto, said opposed flanges of said male mounting member matingly engaging opposed surfaces of said second retangular panel in an edge reinforcing manner, said male and female elongate mounting members being adapted for rigid securement to a support surface and recessed portions in one of said planar surfaces of said first and second panels along the opposed short edges of said first and second rectangular panels, said recessed portions being characterized by the partial absence of gypsum core material from one surface thereof, said paper layer being bonded to the remainder of said gypsum core material in said recess.

48. Securement means for securing panels comprising a female elongate mounting member adapted to be secured to an edge of a panel and comprising a channel-like configuration with solid, continuous wall first and second opposed flanges and an integral, intermediate connecting web portion; said web portion having an intermediate groove, said first and second flanges being adapted to matingly engage opposed surfaces of said panel in an edge reinforcing manner; a male elongate mounting member adapted to be secured substantially and coextensively along another edge of the same or different panel and comprising a channel-like configuration with solid, continuous wall first and second opposed flanges and an integral, connecting web portion having an intermediate tongue adapted to matingly nest with the groove of said female mounting member, said flanges of said male and female members being inwardly directed to provide a clamping action with respect to said mounting members and the edges of said panels with which they are associated.

49. A panel construction comprising the combination: a first elongate panel of gypsum core construction material having front and rear surfaces and first and second opposed lateral edges; a female elongate mounting member secured substantially and coextensively along one of said first and second opposed lateral edges, said female elongate mounting member comprising a channel-like configuration with continuous wall first and second opposed flanges and an integral, intermediate connecting web portion; said web portion having an intermediate groove, said first and second flanges matingly engaging opposed surfaces of said first elongate panel in an edge reinforcing manner; and a male elongate mounting member secured substantially and coextensively along the other of said first and second opposed lateral edges, said male elongate mounting member comprising a channel-like configuration with continuous wall first and second opposed flanges and an integral, connecting web portion having an intermediate tongue adapted to matingly nest within the groove of said female mounting member of a secondly positioned elongate panel, said opposed flanges of said male mounting members matingly engaging opposed surfaces of said first elongate panel in an edge reinforcing manner, said male and female elongate mounting members being adapted for rigid securement to a support surface, said flanges of said male and female mounting members engaging said front surfaces of said panels terminating in an elongate, outwardly directed lip adjacent said intermediate connecting web portions of said male and female mounting members.

50. A panel construction comprising the combination: a first elongate panel of gypsum core construction material having front and rear surfaces and first and second opposed lateral edges; a female elongate mounting member secured substantially and coextensively along one of said first and second opposed lateral edges, said female elongate mounting member comprising a channel-like configuration with continuous wall first and second opposed flanges and an integral, intermediate connecting web portion; said web portion having an intermediate groove, said first and second flanges matingly engaging opposed surfaces of said first elongate panel in an edge reinforcing manner; and a male elongate mounting member secured substantially and coextensively along the other of said first and second opposed lateral edges, said male elongate mounting member comprising a channel-like configuration with continuous wall first and second opposed flanges and an integral, connecting web portion having an intermediate tongue adapted to matingly nest within the groove of said female mounting member of a secondly positioned elongate panel, said opposed flanges of said male mounting members matingly engaging opposed surfaces of said first elongate panel in an edge reinforcing manner, said male and female elongate mounting members being adapted for rigid securement to a support surface, and one of said connecting web portions forming an abutment with the other of said connecting web portions adjacent said front surface and the configuration of at least one of said connecting web portions between said abutment and said rear surface being such that said connecting web portions do not have coextensive planar contact, an adhesive layer being retained therebetween.

51. A panel construction comprising the combination: a first elongate panel of gypsum core construction material having first and second opposed lateral edges, at least one surface of said panel being tapered towards said lateral edges; a female elongate mounting member secured substantially and coextensively along one of said first and second opposed lateral edges, said female elongate mounting member comprising a channel-like configuration with continuous wall first and second opposed flanges and an integral, intermediate connecting web portion; said web portion having an intermediate groove, said frist and second flanges matingly engaging opposed surfaces of said first elongate panel in an edge reinforcing manner; a male elongate mounting member secured substantially and coextensively along the other of said first and seocnd opposed lateral edges, said male elongate mounting member comprising a channel-like configuration with continuous wall first and second opposed flanges and an integral, connecting web portion having an intermediate tongue adapted to matingly nest within the groove of said female mounting member of a secondly positioned elongate panel, said opposed flanges of said male mounting members matingly engaging opposed surfaces of said first elongate panel in an edge reinforcing manner and said flanges engaging said tapered surface of said panel having inclined surfaces, said male and female elongate mounting members being adapted for rigid securement to a support surface; and a spackle-type material applied over said tapered surface of said panel to make the exterior surface thereof substantially planar with said tapered flanges of said male and feamle mounting members.

* * * * *